US006513740B2

(12) United States Patent
Ho

(10) Patent No.: US 6,513,740 B2
(45) Date of Patent: Feb. 4, 2003

(54) BLADE OF A PAPER SHREDDER

(76) Inventor: Ming-Hui Ho, No. 18, 20 Lane, Hsin Feng Street, Hsing Chang City, Taipei Shien (TW)

( * ) Notice: Subject to any disclaimer, the term of this patent is extended or adjusted under 35 U.S.C. 154(b) by 86 days.

(21) Appl. No.: 09/770,058

(22) Filed: Jan. 24, 2001

(65) Prior Publication Data

US 2002/0096584 A1 Jul. 25, 2002

(51) Int. Cl.[7] ..... B02C 18/06; B02C 18/18
(52) U.S. Cl. ..... 241/236; 241/293
(58) Field of Search ..... 241/100, 236, 241/293, 295, 294

(56) References Cited

U.S. PATENT DOCUMENTS 5,160,095 A * 11/1992 Pepper ..... 241/236
5,163,629 A * 11/1992 Raterman et al. ..... 241/167
5,328,107 A * 7/1994 Tsai ..... 241/236
5,676,321 A * 10/1997 Kroger ..... 241/236
6,024,312 A * 2/2000 Spiesshofer ..... 241/166
6,390,400 B1 * 5/2002 Huang ..... 241/295

* cited by examiner

*Primary Examiner*—John M. Husar
(74) *Attorney, Agent, or Firm*—Pro-Techtor International Services

(57) ABSTRACT

A paper shredder has two rotary cutters each having multiple blades spaced apart from each other. Each blade has a first cutting blade with multiple cutting edges and a second cutting blade with multiple cutting edges alternate with respect to the cutting edges of the first cutting blade so that when shredding the paper, only one cutting edge engages the paper.

18 Claims, 3 Drawing Sheets

BLADE OF A PAPER SHREDDER

BACKGROUND OF THE INVENTION

1. Field of the Invention

The present invention relates to a paper shredder, and more particularly to blades of a paper shredder. The paper shredder has two rotary cutters each with multiple blades. Each blade has a first cutting blade with multiple first cutting edges and a second cutting blade with multiple cutting edges. Both the first and the second cutting blades are distributed in a non-equiangular manner and each of the first cutting edges is offset to each one of the second cutting edges, so that there is only one cutting edge engages with the paper to be shredded.

2. Related Prior Art

A conventional paper shredder, when operated, will automatically have the shredded paper fallen into the trash can. However, having the shredded paper fallen into the trash can, the motor of the paper shredder needs to rotate in a reversed direction so as to allow the shredded paper to escape from the rotary cutters to smoothly fall into the trash can, which allows a small amount of shredded paper stuck in the shredder. When the amount of shredded paper increases, the paper shredder will not function normally because multiple cutting edges simultaneously engage with the paper to be shredded. Thus a user will have to disassemble the paper shredder to clean the shredded paper stuck in the shredder to resume the function of the paper shredder. To have a better understanding of the function of the rotary cutters of a paper shredder, a pair of conventional rotary cutters are shown in FIG. 1. The conventional paper shredder has two rotary cutters (1,1') each securely mounted on a polygonal axle (2) (a hexagonal axle is shown in the drawing) and each oppositely rotated with respect to each other. Each rotary cutters (1,1') has multiple cutting blades (4) each spaced apart with one another by a spacer (6) so as to have the multiple blades (4) alternately mounted to each other. Each cutting blade (4) has a through hole (not numbered) defined to correspond to the axle (2) and multiple cutting edges (8) formed on the cutting blade (4) in a equiangular manner. The conventional rotary cutters do have the required performance, however, they still suffer several drawbacks.

1. The cutting edges (8) are equally distributed on the cutting blade (4) so that the cutting force can not evenly distributed along the axial direction of the axle. That is, at least two cutting edges (8) are in contact with the paper to be shredded. In order to provide each of the cutting edges (8) the sufficient power to accomplish the required performance, the paper shredder shall need a motor with a large power, which consumes a large amount of energy.

2. Because there are more than two cutting edges (8) are in contact with the paper, so that the conventional paper shredder create large noise.

3. The gear assembly in the transmission assembly will have to bear a large amount of load due to the engagement of more than two cutting edges with the paper, which results in that the gear assembly will be easily broken.

4. A large amount of paper are being shredded by more than two cutting edges so that the advancement of the paper is not smooth.

The present invention provides an improved blade of a paper shredder to overcome the above mentioned shortcomings.

SUMMARY OF THE INVENTION

The primary objective of the invention is to provide an improved blade for a paper shredder to evenly distributed the shredding force to each of the cutting edges so as to lessen the load on the transmission device of the paper shredder.

Another objective of the invention is to provide an improved blade for a paper shredder. The blade has a first cutting blade and a second cutting blade. Each of the first and the second cutting blades has alternately positioned cutting edges, such that when shredding the paper, only one cutting edge engages with the paper to be shredded. With such an arrangement, the noise of shredding the paper is greatly reduced.

Other objects, advantages and novel features of the invention will become more apparent from the following detailed description when taken in conjunction with the accompanying drawings.

DETAILED DESCRIPTION TO THE PREFERRED EMBODIMENT

Figure 1:
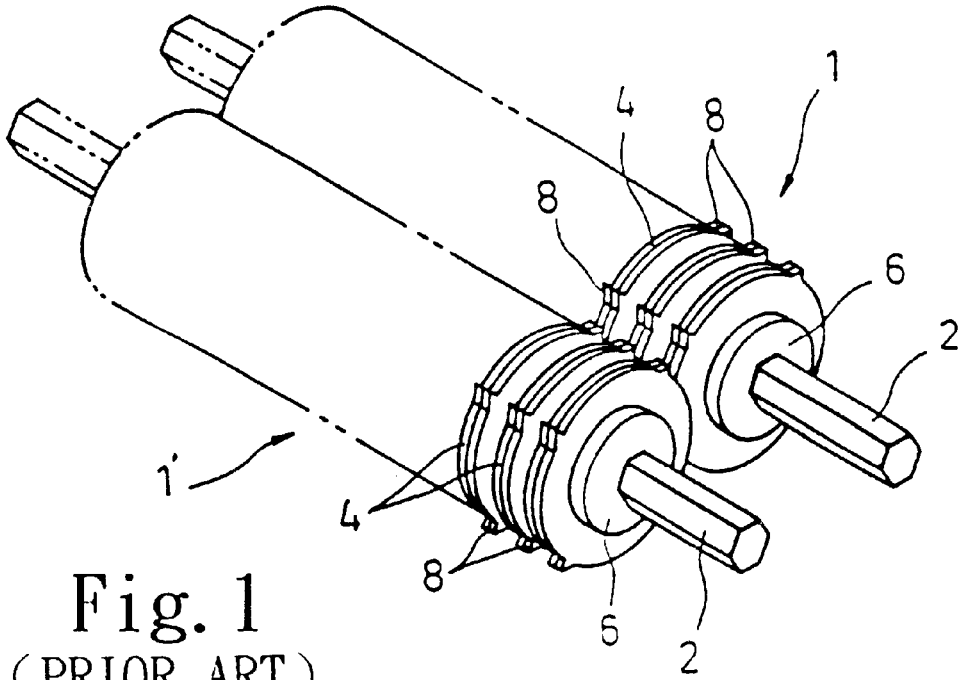
Fig. 1 (PRIOR ART)
FIG. 1 is a perspective view of a conventional blade for a paper shredder.
Figure 2:
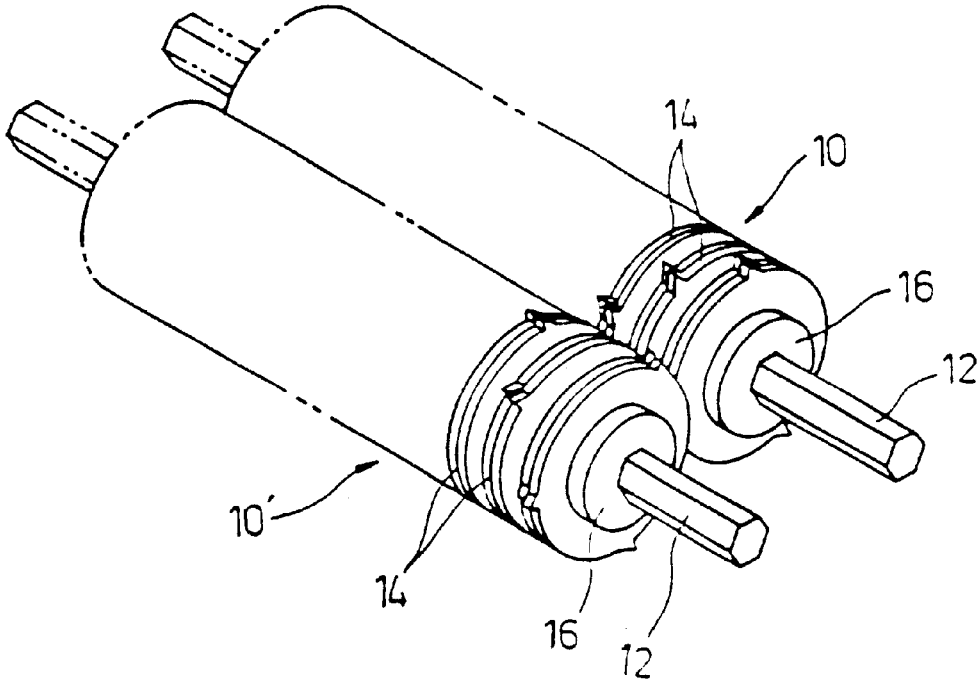
FIG. 2 is a perspective view of a blade constructed in accordance with the present invention.

With reference to FIG. 2, it is noted that the paper shredder of the invention has two rotary cutters(10,10') each with a through hole (not numbered) defined to correspond to and allow the extension of a hexagonal axle (12) and multiple blades (14) securely counted on each of the rotary cutters (10, 10'). Each rotary cutter (10,10') has a spacer (16) located between adjacent blades (14) thereby allowing the blades (14) on each of the rotary cutters (10, 10') to be alternately distributed on the rotary cutter (10.10').

Figure 3A:
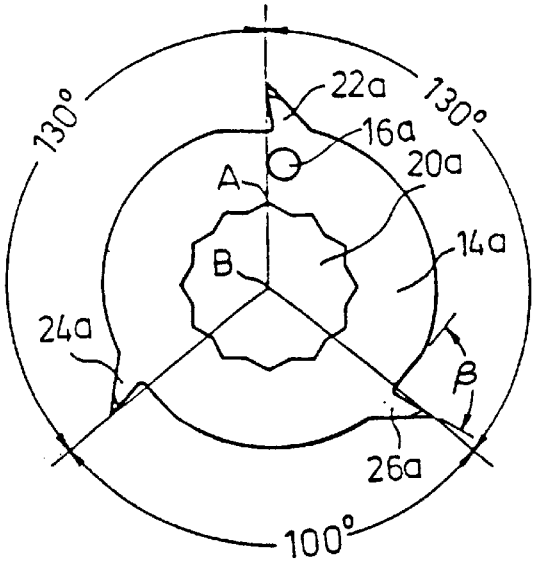
FIG. 3A is a side view of the first cutting blade of the invention.
Figure 3B:
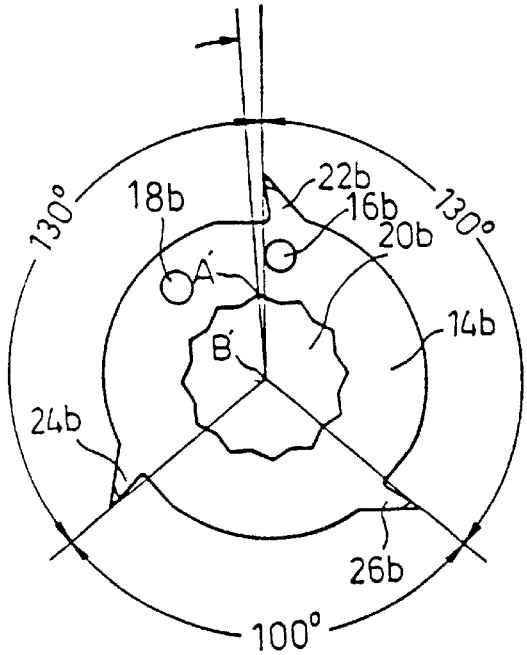
FIG. 3B is a side view of the second cutting blade of the invention.
Figure 3C:
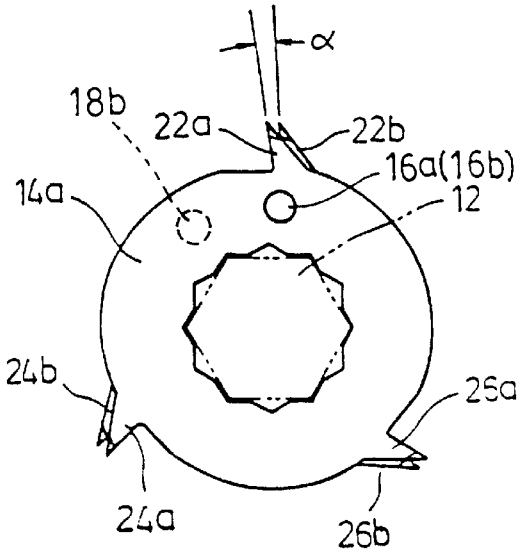
FIG. 3C is a side view of the assembled first cutting blade and the second cutting blade.
Figure 4:
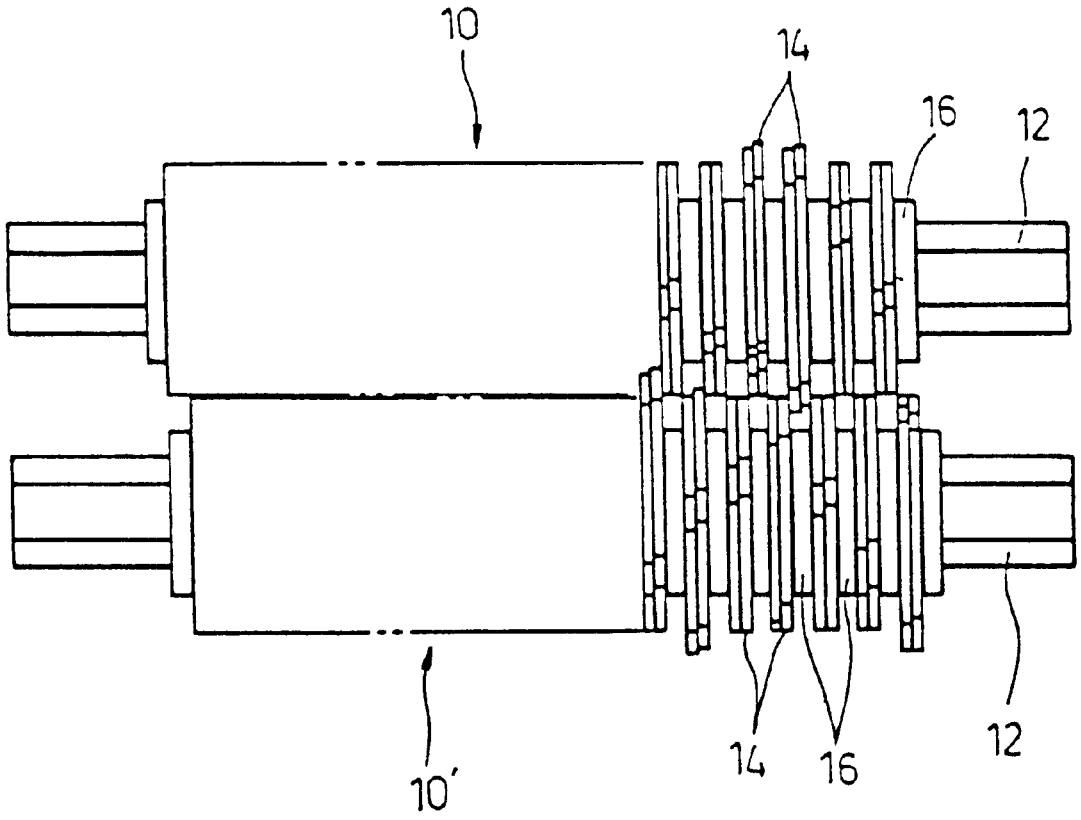
FIG. 4 is a top plan view of the blade of the invention.

With reference to FIGS. 3A, 3B and 3C, each blade (14) has a first cutting blade (14*a*) and a second cutting blade (14*b*).

The first cutting blade (14*a*) has a dodecagon through hole (20*a*) and three cutting edges (22*a*,24*a*,26*a*) extending out from the outer periphery of the first cutting blade (14*a*). The angle between the cutting edges (22*a*,24*a*) and the angle between the cutting edges (22*a*,26*a*) is 130° however, the angle between the cutting edges (24*a*,26*a*) is 100°. That is, the cutting edges (22*a*,24*a*,26*a*) are not arranged on the periphery of the first cutting blade (14*a*) in a equiangular manner. Further, as shown in the drawing, an angle β exists between each cutting edge (22*a*,24*a*26*a*) and a tangential direction from the periphery of the first cutting blade (14*a*) and the angle β is an acute angle. With reference to FIG. 3B, the second cutting blade (14*b*) also has a dodecagon through hole (20*b*) and three cutting edges (22*b*,24*b*,26*b*) extending out from the outer periphery of the first cutting blade (14*b*). The angle between the cutting edges (22*b*,24*b*) and the angle between the cutting edges (22*b*,26*b*) is 130°, however, the angle between the cutting edges (24*b*,26*b*) is 100°. That is, the cutting edges (22*b*,24*b*,26*b*) are not arranged on the periphery of the first cutting blade (14*b*) in a equiangular manner. The overall structure of the second cutting blade (14*b*) is almost the same as that of the first cutting blade (14*a*). The only difference is that when aligning the first cutting blade (14*a*) with the second cutting blade (14*b*), it is noted that a climax A on the periphery of the dodecagon through hole (20*a*) of the first cutting blade (14*a*) is located on a line between a tip of one of the cutting edges (22*a*, 24*a*,26*a*) (FIG. 3A shows 22*a*) and the center (B) of the through hole (20*a*). However, the climax A' on the periphery of the dodecagon through hole (20*b*) of the second cutting blade (14*b*) is located away from the line between a tip of one of the cutting edges (22*b*,24*b*,26*b*) (FIG. 3B shows 22*b*) and the center (B') of the through hole (20*b*). Therefore, when combining the first and the second cutting blades (14*a*,14*b*), as shown in FIG. 3*c*, an angle $\alpha$ exists between the corresponding cutting edges (22*a*,22*b*), (24*a*,24*b*) and (26*a*,26*b*). The angle is between 0°~5° and when the angle is between 3°~4°, the shredding effect will have the best performance.

In order to correspond the corresponding cutting edges (22*a*,22*b*; 24*a*,24*b*; 26*a*,26*b*), a first identification hole (16*a*) is defined in the first cutting blade (14*a*) and two second identification holes (16*b*, 18*b*) are defined in the second cutting blade (14*b*), such that the user is able to quickly tell the difference between the first and the second cutting blades (14*a*,14*b*) when in assembly. To be accurate in assembly, the first identification hole (16*a*) is defined to correspond to one of the two identification holes (16*a*, 18*b*). In the preferred embodiment of the invention, the first identification hole (16*a*) correspond to the second identification hole (16*b*).

To sum up, the cutting edges (22*a*,22*b*; 24*a*,24*b*;26*a*,26*b*) are alternately located on the blade (14) and the total number of the sides of the through hole (20*a*,20*b*) is larger than that of the axle (12) so that only one cutting edge engages with the paper to be shredded.

When in operation, not only the cutting blade (14) will cut the paper into strips, but also the cutting edges (22*a*,22*b*;24*a*, 24*b*;26*a*,26*b*) will tear the strips of paper into fragments to ensure the safety of information. Furthermore, because there is only one cutting edge engages with the paper, the load on the motor is greatly reduced so as the noise.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A blade for a paper shredder has two rotary cutters each with a through hole defined to correspond to and allow the extension of an axle, multiple blades securely mounted on each of the rotary cutters and spacers each located between adjacent blades thereby allowing the blades on each of the rotary cutters to be alternately distributed on the rotary cutter, wherein the improvements comprise:

the blade having a first cutting blade with multiple first cutting edges non-equiangularly distributed on a periphery of the first cutting blade and each of the first cutting edges being inclined to an acute angle with respect to a tangential direction from the periphery of the first cutting blade and a second cutting blade with multiple second cutting edges each being offset to a corresponding one of the first cutting edges for an angle, the first cutting blade further having a first identification hole and the second cutting blade having at least one identification hole corresponding to the first identification hole of the first cutting blade.

2. The blade as claimed in claim 1, wherein the first cutting blade and the second cutting blade each has a through hole adapted to allow extension of the axle.

3. The blade as claimed in claim 2, wherein the through hole has sides which are twice in number with respect to the sides of the axle.

4. The blade as claimed in claim 3, wherein the angle is between 0°~5°.

5. The blade as claimed in claim 4, wherein the angle is between 3°~4°.

6. The blade as claimed in claim 2, wherein the angle is between 0°~5°.

7. The blade as claimed in claim 6, wherein the angle is between 3°~4°.

8. The blade as claimed in claim 1, wherein the angle is between 0°~5°.

9. The blade as claimed in claim 8, wherein the angle is between 3°~4°.

10. A blade for a paper shredder has two rotary cutters each with a through hole defined to correspond to and allow the extension of an axle, multiple blades securely mounted on each of the rotary cutters and spacers each located between adjacent blades thereby allowing the blades on each of the rotary cutters to be alternately distributed on the rotary cutter, wherein the improvements comprise:

the blade having a first cutting blade with three first cutting edges non-equiangularly distributed on a periphery of the first cutting blade and each of the first cutting edges being inclined to an acute angle with respect to a tangential direction from the periphery of the first cutting blade and a second cutting blade with three second cutting edges each being offset to a corresponding one of the first cutting edges for an angle; wherein the first cutting blade further has a first identification hole, and the second cutting blade has at least one identification hole corresponding to the first identification hole of the first cutting blade.

11. The blade as claimed in claim 10, wherein the first cutting blade and the second cutting blade each has a through hole adapted to allow extension of the axle.

12. The blade as claimed in claim 11, wherein the through hole has sides which are twice in number with respect to the sides of the axle.

13. The blade as claimed in claim 12, wherein the angle is between 3°~5°.

14. The blade as claimed in claim 13, wherein the angle is between 3°~4°.

15. The blade as claimed in claim 11, wherein the angle is between 0°~5°.

16. The blade as claimed in claim 13, wherein the angle is between 3°~4°.

17. The blade as claimed in claim 10, wherein the angle is between 0°~5°.

18. The blade as claimed in claim 17, wherein the angle is between 3°~4°.

* * * * *